United States Patent [19]

Jennings et al.

[11] Patent Number: 4,822,035

[45] Date of Patent: Apr. 18, 1989

[54] ADJUSTABLE BARBELL BAR WITH ROTATING HANDLES

[75] Inventors: Homer F. Jennings, Olney, Ill.; Ozzie Martinez, Aptos, Calif.

[73] Assignee: Weider Health & Fitness, Woodland Hills, Calif.

[21] Appl. No.: 890,405

[22] Filed: Jul. 25, 1986

[51] Int. Cl.[4] ..... A63B 13/00

[52] U.S. Cl. ..... 272/123

[58] Field of Search ..... 272/67, 117, 123, 143, 272/DIG. 4

[56] References Cited

U.S. PATENT DOCUMENTS

| | | | |
|---|---|---|---|
| 4,461,473 | 7/1984 | Cole | 272/123 |
| 4,585,229 | 4/1986 | Brasher | 272/123 |
| 4,618,143 | 10/1986 | Twardosz | 272/123 |
| 4,629,184 | 12/1986 | Selkee | 272/123 |
| 4,690,400 | 9/1987 | Metz | 272/123 |
| 4,743,017 | 5/1988 | Jaeger | 272/143 X |

FOREIGN PATENT DOCUMENTS

| | | | |
|---|---|---|---|
| 223926 | 6/1985 | German Democratic Rep. | 272/123 |

*Primary Examiner*—Richard J. Apley
*Assistant Examiner*—Robert W. Bahr
*Attorney, Agent, or Firm*—Blakely, Sokoloff, Taylor, Zafman

[57] ABSTRACT

A barbell is disclosed having a pair of handles disposed along the length thereof equidistant from the ends of the barbell. The handles are rotatable through an axis transverse to the long axis of the plane of the barbell, so that the handle can be rotated to position comfortable to a user's arms for performing various exercises. The barbell is also optionally adjustable in length so that the handles can be positioned at a predetermined distance from each other.

10 Claims, 2 Drawing Sheets

ADJUSTABLE BARBELL BAR WITH ROTATING HANDLES

FIELD OF THE INVENTION

This invention relates to the field of weight-lifting equipment, and more particularly, to a weight lifting bar having handles which rotate through an axis transverse to the weightlifting bar.

BACKGROUND OF THE PRIOR ART

The standard weight lifting barbell consists of a straight elongated bar with collars near the ends thereof to retain weighted plates on the bar. The straight bar was used for many years for all types of weight lifting exercises, such as, by way of example, military and bench presses, curls, and tricep extensions.

However, it was found that the straight bar was not the best suited device for certain exercises because in using the straight bar the user's wrists were sometimes awkwardly positioned making such exercises more difficult, somewhat painful and possibly dangerous. Moreover, in order to properly isolate specific muscle groups during weight lifting exercises it is sometimes necessary for a user to position his arms in a particular rotational angle with respect to the bar, which, of course, is impossible considering the configuration of a straight bar. It is evident that with a standard barbell, there are only two basic positions in which a user's arms may be positioned, namely palms up and palms down. However, the distance between the user's hands may be adjusted to some degree, by positioning the same along the bar. Every other possible position of the arms is restrained by the fact that the bar is unitary and straight.

To overcome the problem of inadequate variation in the positioning user's arms with respect to the barbell, a number of different types of specialized barbells have been devised which permit the user to rotationally position his arms at a specific rotational angle with respect to an axis transverse to the barbell to perform certain exercises. For example, there is a curling barbell comprising a generally linear bar having V-shaped grip portions along its length so that the user can hold the bar with his wrists twisted inward (or outward) to avoid discomfort when performing curl exercises or to isolate certain muscle groups in the arm. There is also a tricep or extension bar which has two handles disposed perpendicular to the long axis of the barbell, so that, in use, the user's fists can face inward towards each other thereby better isolating the triceps. However, each of the foregoing prior art barbells has handles which are fixed in position relative to the long axis of the barbell. Thus, there is no barbell in the prior art which can be converted from a straight barbell to a curling barbell, tricep barbell or both, and further, is adjustable to any rotational angle desired by the user.

In addition, barbells, and particularly specialized barbells, such as the foregoing curling and tricep barbells are provided having a fixed length, with the handles thereof being a fixed and predetermined distance apart. This is a particular problem in the case of specialized bars, more than the standard barbells, because users are different sizes and their hands should be accordingly spaced corresponding distances apart. At least with standard barbells, the user can place his hands anywhere along the bar. However, because the specialized barbells have fixed handles, the user's arms must be positioned at the fixed distance apart. In addition, the handles for tricep bars are relatively close together, as compared with curling bar handles, which are approximately spaced shoulder distance apart. None of the prior art barbells, standard or specialized, have handles, the distance between which can be varied.

The present invention overcomes the limitations of the prior art providing a unitary device having rotating handles capable of acting as a standard barbell, tricep bar and curling bar, and optionally, having handles that can be adjustably spaced apart.

SUMMARY OF THE INVENTION

The invented adjustable handle barbell comprises an elongated or substantially rectangular bar having two substantially circular co-planar handle tracks disposed near the ends of the bar or rectangle. A handle is disposed within each track and is adjustably mounted therein so that it can be rotated relative to the long axis of the barbell to selected position and can be fixed in the selected position. The length of the bar and the coincident distance between the handles can also be adjusted so that the barbell can be comfortably utilized by persons of different sizes, and for the various exercises. The ends of the bar are adapted to accommodate plates of weights in the same way that standard barbells accommodate such plates.

In the preferred embodiment, the invented barbell comprises a substantially rectangular-shaped frame formed of tubing. A pair of circular handle tracks are coupled to said frame at opposite ends. For additional integrity of the device, each of the handle tracks has an outer diameter which abuts and is attached to the inner periphery of the device on three sides bridging across the short side of the rectangular frame. The preferred structure provides both a secure attachment of the handle track to the frame, and braces the frame thereby limiting flex and increasing its life. The entire frame is formed of tubing making it light and strong.

The length of the frame, and correspondingly, the distance between the handles is adjustable in the preferred embodiment. This enables the user to position the handles a comfortable distance apart within a wide range to accomodate the user as to the type of exercise desired, the angular position of the handles and the user's size. The frame is designed to telescope or extend, and then lock in position at any length within a predetermined range.

Each handle comprises a cylinder with a turnbuckle assembly for adjusting its length to apply frictional pressure to the handle track to secure the handle in a desire position. At the outside end of each handle is a clamp means adapted to clamp onto the handle track. The rotation of the cylinder causes at least one screw therein of the turnbuckle assembly to move out or in, depending upon the direction of rotation, so that the clamp means on the handle engages or disengages the handle track, thereby locking or releasing the handle relative to the handle track.

In another embodiment, the invented barbell comprises a pair of parallel bars connected at each end by a substantially circular member which forms the handle track. A cylindrical handle is disposed within each handle track as a described above. Each parallel bar is slidably adjustable in length so that the distance between the handles can be varied. A locking means, such as a locking bolt or clamp, is attached to each of the parallel bars to fix the bars at a desired length.

At the ends of the barbell, coupled to each handle track along the long axis of the barbell are bars for supporting the weight plates in the conventional manner utilized by a standard barbell. Disposed on each weight support bar is a collar for holding said weight plates thereon.

DETAILED DESCRIPTION

Figure 1:
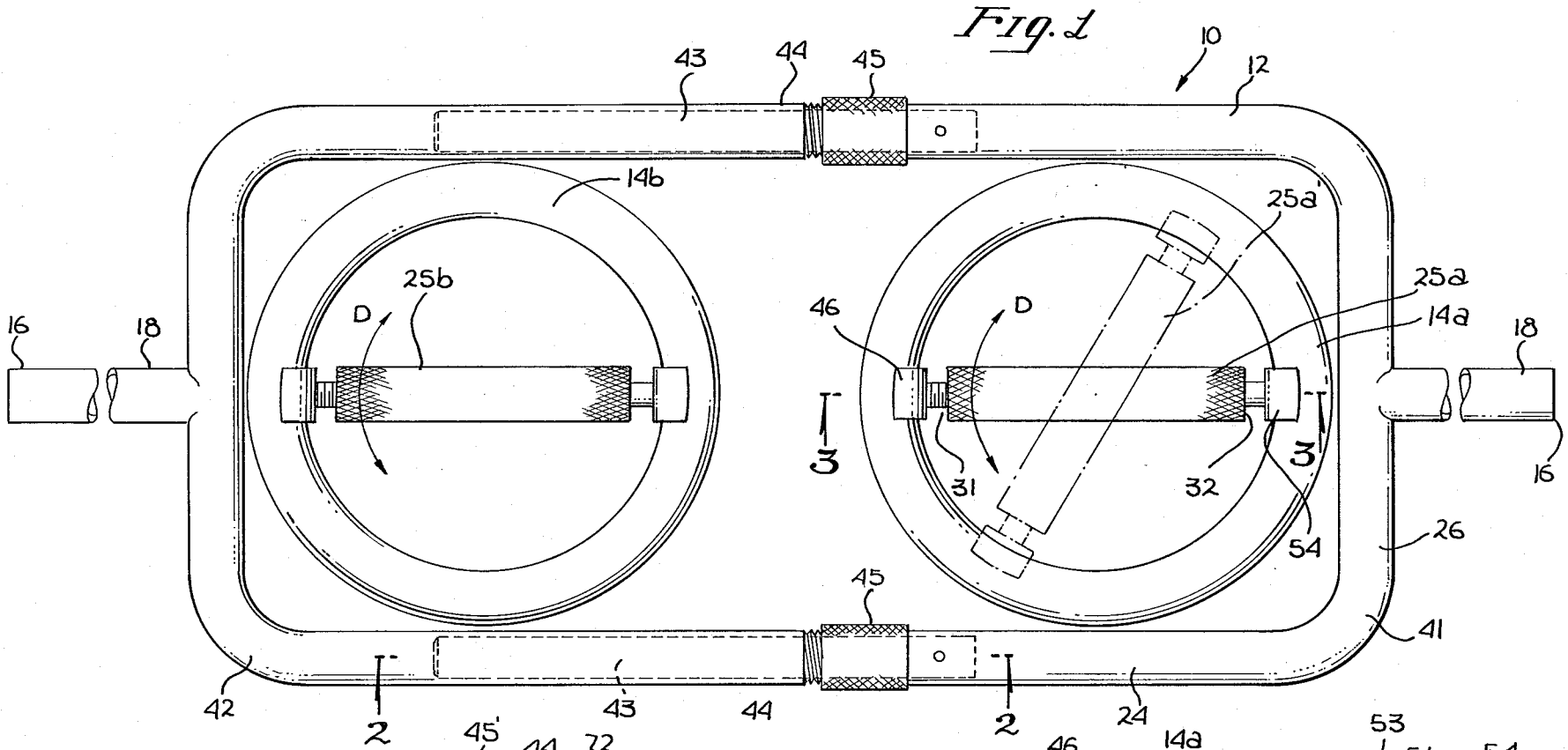
FIG. 1 illustrates a front view of the preferred embodiment of the present invention.
Figure 3:
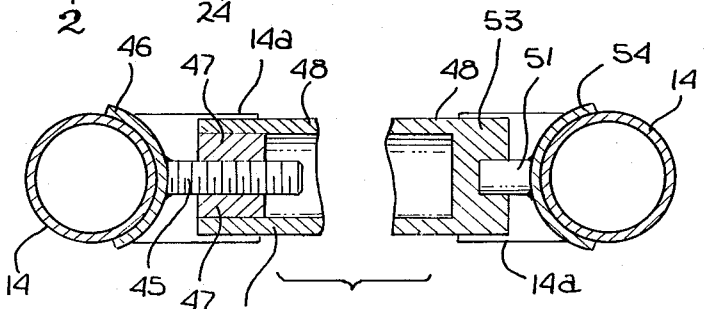
FIG. 3 illustrates an enlarged, discontinuous, cross-sectional view of the handle of the present invention taken through lines 3—3 of FIG. 1.
Figure 2:
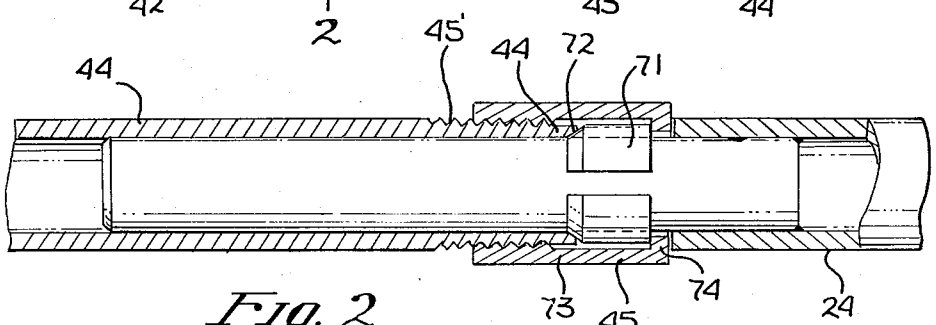
FIG. 2 illustrates a cross-sectional view of one arm of the present invention taken through line 2—2 of FIG. 1.
Figure 4:
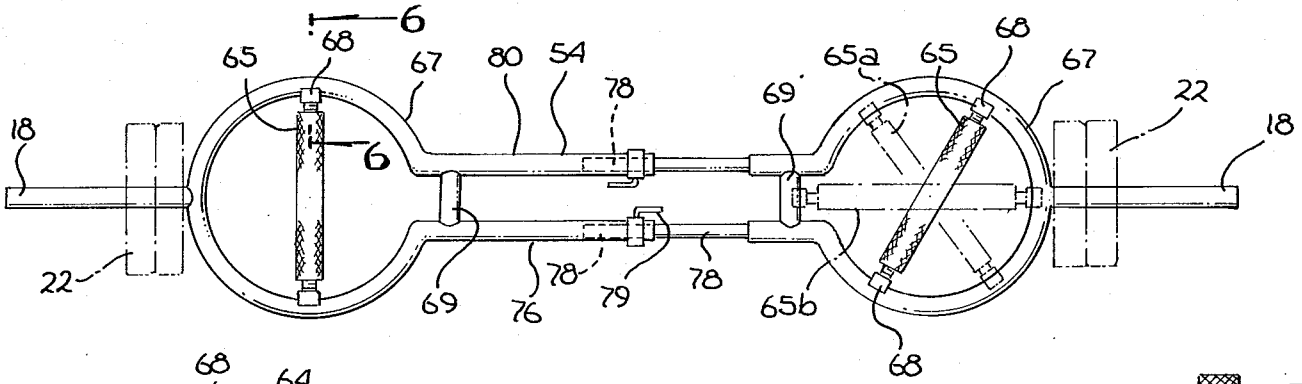
FIG. 4 illustrates the another embodiment of the present invention with on handle depicted at various possible positions in ghost lines.
Figure 6:
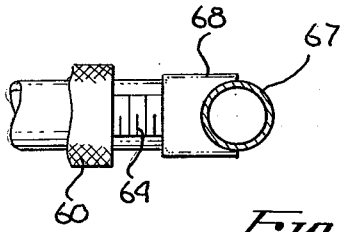
FIG. 6 illustrates an enlarged cross-sectional view of the handle of the present invention taken through lines 6—6 of FIG. 4.
Figure 5:
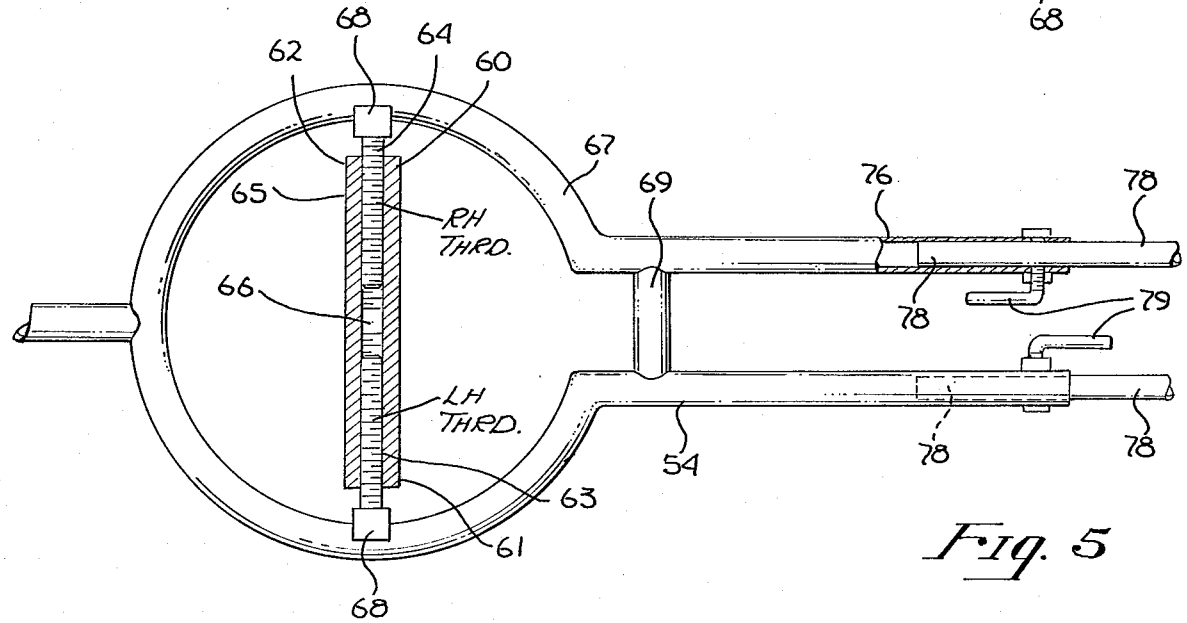
FIG. 5 illustrates an enlarged partial view of the present invention taken through lines 5—5 of FIG. 4.

The present invention can best be understood with reference to the appended drawings for which FIGS. 1-3 depict the preferred embodiment of the invention, and FIGS. 4 and 5 depict an alternative embodiment of the present invention. In its general form, the invented barbell 10 comprises a frame or bar member 12 having two substantially circular handle tracks 14, each handle track being disposed equidistant from each end 16 of the bar member 12. End bars 18 are provided at the ends of said barbell 10 and are adapted to hold weight plates 22 thereon, as shown in FIG. 4, in the standard manner as is known in the prior art. FIG. 1 also shows a discontinuous view of weight support bar 18, which is shown in full in FIG. 4. Weights may be disposed thereon as is conventionally done in the prior art. Disposed within each track 14 is a handle 25 adapted to rotate circularly through an axis transverse to the plane of track 14 and be fixed in selected positions therewithin. The length of bar member 12 is optionally adjustable to accommodate the size of the particular user and to enable the user to utilize the device for a variety of exercises.

Turning now to the preferred embodiment illustrated in the drawings, all of the elements of the present invention which are common to both handles or handle tracks will generally be referred to by a single numeral, unless the designation of each element separately is required for clarity. For example handle track 14 refers to both handle tracks of the present invention, whereas the designation handle track **14*a* and handle track 14*b*** is used when differentiation of the handle tracks is important.

As shown in FIG. 1, the bar member 12 comprises a generally rectangular tubular structure having a long adjustable side 24 and a short side 26. Of course it will be recognized by one skilled in the art that a single bar, a plate, or other similarly shaped frame may instead be used in place of a rectangular structure and such is contemplated a being within the scope of the present invention. However, it is believed that the rectangular structure of the preferred embodiment provides greater tortional stability relative to a unitary central bar in view of the mechanical stress resulting thereon from certain handle positions.

As specifically shown in FIG. 1, the bar member 12 comprises two generally U-shaped members 41 and 42, with the ends 43 of U-shaped member 41 (shown in ghost lines) being insertable into the ends 44 of U-shaped member 41. U-shaped members 41 and 42 are coupled together by coupling means 45 which allows ends 43 to slide in and out of end 44 so that long adjustable side 24 can be shortened or lengthened and the distance between handle tracks **14*a* and 14*b* adjusted. In addition, coupling means 45 can secure U-shaped bar 42 in position relative to U-shaped bar 41 thereby fixing the length of side 24**.

Also shown in FIG. 1, handle tracks **14*a* and 14*b* are provided with handles 25*a* and 25*b*, respectively, contained therein. As shown, handles 25*a* and 25*b* are aligned with the long axis of the barbell 10. Arc D within handle tracks 14*a* and 14*b* indicates the directions of rotation of handle 25 and 25*b*. Handle 25*a'* drawn in ghost lines shows one alternate position of handle 25*a*; however, it will be appreciated by one skilled in the art that handles 25*a* and 25*b* can rotate to any position within the handle tracks 14*a* and 14*b* thereby allowing a user to perform a multitude of different exercises and a number of variations on specific exercises by positioning the handles as desired. For example, for curls, the handles may be positioned in alignment with the long axis of the barbell 10. Alternatively, the handles may be turned inward or outward so that, in use, the user's palms face toward or away from each other. As another alternative, it may be desirable to have the handles disposed perpendicular to the long axis L of the barbell 10. It may also be desirable during an exercise to allow the handles to freely rotate to any position within the handle track 14** so that the most comfortable wrist position of the user can be achieved without any risk of discomfort as the rotational angle of the handle changes during arm movement in a particular exercise.

Handles **25*a* and 25*b* can rotate continuously through handle tracks 14*a* and 14*b* or possibly only be locked in position at specified predetermined increments. In the preferred embodiment, the handles 25 are continuously rotatable throughout the handle track 14 and may be locked in any desired position. As shown in FIGS. 1 and 3 the handle 25 in the preferred embodiment comprises a turnbuckle assembly to adjust its length. FIG. 3 is enlarged discontinuous cross-sectional view of the preferred handle 25*a*. End 31 of handle 25*a* comprises a threaded screw member 45 coupled at one end to C-shaped member 46 which surrounds at least a portion of handle track 14. Threaded screw member 45 threads into threaded nut member 47 which is attached to sleeve 48 comprising the main part of handle 25. At end 32, post 51 is fixed within handle sleeve end 53 so that it can freely rotate therewithin, but cannot readily be removed therefrom. Post 51 is coupled to C-shaped member 54, which engages handle track 14**.

In use, the handle is twisted so that the threaded screw member 45 threads into or out of threaded nut member 47. When threaded in, the length of the handle 25 decreases, and when threaded out, the length of the handle increases. In the preferred embodiment, the handle becomes fixed in position when the C-shaped members press outward against the inside surface of the handle track 14, as the length of the handle is increased. Conversely, to change position of the handle, the length is decreased so that the handle 25 disengages the track 14.

Shown in FIGS. 4 and 5 is handle 65, comprising an alternative embodiment turnbuckle assembly to adjust its length, said turnbuckle assembly comprising an internally threaded handle sleeve 60, with one end 61 being internally threaded for a left hand screw 63, and the other end 62 being internally threaded for a right hand screw 64. The left hand screw 63 and right hand screw 64 are disposed in their properly mated respective ends. There is a gap 66 near the center of said sleeve 60 between the left hand screw 63 and right hand screw 64 of sufficient length that the handle 65 can be loosened and rotated about the circular track 67. At the outer ends of each of the left hand screw 63 and right hand screw 64 is a C-shaped member 68 which surrounds at least part of the cross-section of the handle track 67 and holds the handle 65 onto the track, even when transversely directed force is applied thereto. This C-shaped member 68 prevents the handle 65 from slipping out of the track 67 during use, which obviously can be very dangerous.

By twisting the sleeve 60 relative to the handle track 66, the screws 63 and 64 are held rotationally fixed in place by virtue of the C-shaped member 68 being forced against the handle track 67, and the screws are thereby are retracted in, or extended from, the sleeve 60, depending on the direction of rotation of the sleeve 60. Thus, in this embodiment, the handles 65 can be continuously rotationally position at any angle within the handle track 67. Possible positions of handle 65 are shown in FIG. 4 as 65*a* and 65*b*.

It will be obvious to one skilled in the art that any other equivalent means for adjusting the angle of the handle with respect to the barbell can also be adopted. For example, the handle may be fixed within the track and the entire track may rotate relative to the barbell. In another embodiment, the handles may apply pressure to the outer circumference of the track, rather than the inner circumference, with the threads of the sleeve, screws and arranged in the same manner as previously described. However, in such embodiment in place of a C-shaped member 68 which is adapted to press outward, an inwardly directed clamp may be coupled to the screws and may be positioned to pull inward from the outside of the track, in place of outwardly directed force from the inside.

In length of the long adjustable side 24 is preferably adjustable, as noted above. In one embodiment, as shown in FIG. 2, length of the side 24 is adjustable by means of an arm coupling means 45 which comprises a flexible clamp member 71 surrounding end 43. Flexible clamp member 71 is spring-like and capable of reversibly clamping end 43 to secure it in place, and releasing end 43 allowing it to slide through coupling member 45 to permit side 24 to extend. Clamp member 71 has a beveled edge 72 which abuts end 44, so that when nut 73 is screwed into threads 75 in direction T, flange 74 drives clamp member 71 in direction T and against end 44 so that clamp member 71 tightens on end 43.

In another embodiment as shown in FIGS. 4 and 5, the invented barbell 80 comprises parallel bars 54 joined at the ends thereof by attachment to the handle tracks 67. Parallel bars 54 may be fixed in length, although in the preferred embodiment, the length of each bar is adjustable. A number of different means of adjusting the length of parallel bars 54 can be used which are well-known in the art. In the presently preferred embodiment, each of the parallel bars 54 comprise a sleeve 76 which is slightly larger than arm 78 slidably disposed therewithin. The insertion of the arms 78 within sleeves 76 are shown in phantom lines in FIGS. 4 and 5. As an alternative method of extending the length of the bars, one bar may be externally threaded and the other bar, having a slightly larger diameter maybe internally threaded so that the length of the bars can be varied by screwing the smaller diameter bar into or out of, the larger bar.

Locking or clamp means 79 are disposed at the juncture between arms 78 and sleeves 76, to secure the arms 78 and sleeves 76 in a fixed position with respect to each other. In another embodiment, the arm and sleeve may be drilled through with holes, with the holes on the arm and/or sleeve positioned at preselected increments therealong so that the distance between the handle tracks 67 is adjustable in said predetermined increments.

In the method of manufacturing the invented barbell, the handle tracks 67 are not unitarily circular in shape, but instead, are partially circular in shape with the parallel bars 54 extending from the ends of each circle. In view of this, in order to complete the circular handle track 67, interconnecting members 69 are disposed between parallel bars 54 interconnecting them, and completing the circular track 67. The interconnecting members 69 also provide tortional stability to the bar, which is believed to be significant given that the force exerted by the handle 65 on the handle track 67 can vary substantially depending on the rotational angles of the handle 65 and the direction of movement of the barbell during exercise.

The rotational position of the handle can be selected for the user's comfort and to accommodate the user for various types of exercises. In addition, the length of the bar, and the coincident distance between the handles can similarly be adjusted for the same purpose. For example, for use of the invented barbell as a curling bar, it is suggested that the handles be angled so that they face slightly inward toward each other (so that the user's fists face slightly inward in use) for improved user comfort, and that the handles be approximately shoulder width, or slightly larger, apart. For use of the invented barbell as a tricep bar, the handles are positioned perpendicular to the long axis of the barbell, and narrower than shoulder width. Other variations can be adopted for various other exercises, and to emphasize the benefits of the workout by isolating certain muscle groups.

Having described the present invention, and particularly in detail, the preferred embodiment thereof, it will be obvious to one of ordinary skill in the art that a number of modifications can be made thereto without departing from the spirit and scope of the invention. The invention should not be construed as being limited to the specifically disclosed preferred and alternate embodiments illustrated herein, but rather, is only limited by the claims appended hereto and all reasonable equivalents thereof.

Wherefore, we claim:

1. A barbell comprising:

two generally U-shaped member forming a generally elongated rectangular telescoping frame having two ends and two parallel bars, said frame comprising a telescoping means disposed between said U-shaped members for continuously adjusting the distance between the ends of said frame;

a pair of substantially circular handle tracks, each handle track being secured to each of said parallel bars and an adjacent end;

an end weight support bar disposed on each end of said frame and adapted to support weight plates thereon; and a handle disposed along the diameter of each of said handle tracks, said handle being rotationally movable through an axis transverse to the plane defined by said handle track, and having a locking means for reversibly securing said handle in a desired rotationally angle in said handle track.

2. The barbell of claim 1 wherein said weights supports bar are aligned along the long axis of said elongated bar.

3. The barbell of claim 1, wherein said length adjusting means comprises a sleeve member disposed on each end of one of said U-shaped members and adapted to receive an adjacent portion of said other U-shaped member in a telescoping manner to adjust the length of said frame.

4. The barbell of claim 1 wherein said handle comprises a turnbuckle assembly for adjusting the length of said handle and clamp means disposed on each end of said handle for mating with said handle track.

5. The barbell of claim 4 wherein said clamp means frictionally clamps onto the interior surface of said handle track and frictionally engages said interior surface to thereby secure said handle in a desired position.

6. The barbell of claim 4 wherein said handle comprises a C-shaped member disposed at each end thereof and adapted to partially capture said handle track.

7. A barbell comprising:

an elongated extendable rectangular frame;

a pair of circular co-planar handle tracks, one handle track disposed near each end of said frame, each circular handle track being coupled to three sides of said frame on the inside perimeter thereof;

a handle disposed along the diameter of said handle track, said handle being rotatable through an axis transverse to the plane of said rectangular frame; and a frame length adjustment means comprising a reversible extension for reversibly lengthening or shortening the length of said frame, and a locking means for locking said frame at a desired length, said length adjusting means comprising a sleeve disposed on a portion of said frame and adapted to receive an adjacent portion of said frame in a telescoping manner to adjust the length of said frame.

8. The barbell of claim 7 wherein said handle comprises a turnbuckle assembly for adjusting the length of said handle and clamp means disposed on each end of said handle for mating with said handle track.

9. The barbell of claim 8 wherein said rotational position of said handle is incrementally adjustable.

10. The barbell of claim 8 wherein said handle comprises a C-shaped member disposed at each end thereof and adapted to partially capture said handle track.

* * * * *

UNITED STATES PATENT AND TRADEMARK OFFICE

CERTIFICATE OF CORRECTION

PATENT NO. : 4,822,035

DATED : 4/18/89

INVENTOR(S) : Jennings et al.

It is certified that error in the above-identified patent and that said Letters Patent is hereby corrected as shown below:

| | | |
|---|---|---|
| col. 02, line 19 | after "to" | insert --a-- |
| col. 03, line 17 | delete "on" | insert --one-- |
| col. 03, line 63 | delete "a" | insert --as-- |
| col. 06, line 60 | delete "member" | insert --members-- |

Signed and Sealed this

Fourth Day of February, 1992

*Attest:*

HARRY F. MANBECK, JR.

*Attesting Officer*

*Commissioner of Patents and Trademarks*